US005281069A

United States Patent [19]

Tsujimoto

[11] Patent Number: 5,281,069

[45] Date of Patent: Jan. 25, 1994

[54] LIFT DEVICE AND AUTOMATED HIGH-RAISED PARKING SYSTEM HAVING THE LIFT DEVICE

[75] Inventor: Kazushi Tsujimoto, Kasugai, Japan

[73] Assignee: Daifuku Co., Ltd., Osaka, Japan

[21] Appl. No.: 969,005

[22] Filed: Oct. 30, 1992

[30] Foreign Application Priority Data

Nov. 26, 1991 [JP] Japan ..... 3-310310
Jan. 10, 1992 [JP] Japan ..... 4-002672
Jan. 14, 1992 [JP] Japan ..... 4-004448

[51] Int. Cl.[5] ..... E04H 6/22

[52] U.S. Cl. ..... 414/231; 187/1 R; 187/94; 212/156; 414/239

[58] Field of Search ..... 414/231, 233, 234, 239, 414/240, 252, 264, 673; 187/1 R, 94, 105, 106; 212/195-198, 156

[56] References Cited

U.S. PATENT DOCUMENTS 2,816,624 12/1957 Asheim et al. ..... 187/94 X
3,786,930 1/1974 Obregon ..... 414/264 X
3,880,258 4/1975 Rompa ..... 187/94 X
4,222,140 9/1980 Olewinski et al. ..... 187/94 X
4,322,804 3/1982 Evans ..... 414/231 X
4,747,242 5/1988 Aarstad ..... 414/233 X
4,936,730 6/1990 Morioka ..... 414/239
5,018,926 5/1991 Sternad ..... 414/234 X
5,108,254 4/1992 Go ..... 414/231 X

*Primary Examiner*—David A. Bucci
*Attorney, Agent, or Firm*—Webb, Burden, Ziesenheim & Webb

[57] ABSTRACT

A lift device includes a cable member having opposed ends thereof suspended via guide members and longitudinally movable by a lift drive unit, a lift unit connected to one of the ends of the cable member for lifting an object along a lift passage, a balance weight connected to the other end of the cable member and movable along a balance-weight lift passage, a detection device for detecting a height of the balance weight to check whether or not the balance weight is positioned higher than a lower end of the balance-weight lift passage by a predetermined value when said lift unit is moved to its uppermost position, and a warning device for warning an abnormal elongation of the cable member if the detection device detects that the balance weight is not positioned higher than the lower end of the balance-weight lift passage by the predetermined amount. The invention also discloses an automated high-raised parking system using this lift device.

17 Claims, 12 Drawing Sheets

LIFT DEVICE AND AUTOMATED HIGH-RAISED PARKING SYSTEM HAVING THE LIFT DEVICE

BACKGROUND OF THE INVENTION

1. Field of the Invention

The present invention relates to a lift device and an automated high-raised parking system having the lift device, and more particularly to a lift device vertically movable along a lift passage and including a cable member supported and guided by a guide member to suspend opposed terminal ends and longitudinally driven by a lift drive unit, a lift unit connected to one of the ends of the cable member and a balance weight connected to the other end of the cable member and an automated high-raised parking system having such lift device.

2. Description of the Related Art

With a conventional lift device of the above-noted type, drive operations of the cable member by the lift drive unit are controlled based only on information relating to a present position of the lift unit in the lift passage.

There occurs, however, gradual elongation in the cable member after its use with heavy loads for an extended period of time. And, such elongation can often be considered as a sign of fatigue or eventual breakage of the cable member. Then, according to the above convention, since the operation of the cable member is controlled based solely on the information concerning a present position of the lift unit in the lift passage, a position of the balance weight will be displaced downwards by an amount corresponding to the amount of the elongation of the cable member. For this reason, there is a risk that the balance weight may accidentally hit a lower end of the lift passage or that with further use of the cable member as it is there may occur an accident of cable breakage. In order to avoid such danger or accident, a maintenance or check operation must be regularly done by a maintenance person.

SUMMARY OF THE INVENTION

A primary object of the present invention is to solve the above-described drawback of the conventional art by providing an improved lift device and an automated high-raised parking system having this device which device allows to prevent such danger or accident without regular maintenance or check operation by a maintenance person thereby to reduce the maintenance costs of the lift device and of the parking system using this lift device.

For accomplishing the above-noted object, a lift device, according to the present invention, comprises detection means for detecting a height of the balance weight to check whether or not the balance weight is positioned higher than a lower end of a balance-weight lift passage by a predetermined value when the lift unit is moved to its uppermost position and further comprises warning means for warning an abnormal elongation of the cable member if the detection means detects that the balance weight is not positioned higher than the lower end of the balance-weight lift passage by the predetermined amount.

Functions and effects of the above-described construction of the present invention will be described next.

According to the construction comprising the above characterizing features of the present invention, as the detection means can detect if the balance weight is positioned higher than the lower end of the balance-weight lift passage by the predetermined amount or not when the lift unit is moved to the uppermost position, any elongation in the cable member can be detected. Further, with detection of abnormal elongation in the cable member by the detection means, the warning means provides a user or operator of this abnormal elongation in the cable member.

Therefore, the construction of the present invention is effective for avoiding such accident as the hitting of the balance weight against the lower end of the balance-weight lift passage or the breakage of the cable member. Further, since any maintenance or replacement operation of the components when necessary may be done at a desired time out of the service hours of the system, thereby to avoid the inconvenience of emergency stop of the system during the service hours. Also, the lift device according to the invention can solve the trouble of regular maintenance and check operations by a maintenance person.

According to another aspect of the present invention, the automated high-raised parking system further comprises further detection means for detecting whether an automobile introduced into an entrance/exit section of the system is positioned within a predetermined zone provided at the entrance/exit section along a direction of the width of the automobile, and also abnormality-management means activated when the further detection means detects absence of the automobile within the predetermined zone.

With the above features of the present invention, the system automatically detects if the automobile introduced into the entrance/exit section is positioned within the predetermined zone provided at the section along the automobile width and copes with occurrence of abnormality when the automobile is not positioned within the predetermined zone. So that, it is not necessary for a system attendant or user to see if the automobile is properly positioned or not. The parking system thus avoids the inconvenience of manual checking operation.

According to a further aspect of the present invention, in the automated high-raised parking system described above, the detection means comprises a pair of sensors for detecting if opposed lateral sides of the automobile as being lifted by the lift unit are located within the predetermined zone or not.

With the above feature, the detection means for effecting the above-described detection comprises the sensors for detecting if the opposed lateral sides of the automobile are located within the predetermined zone as the automobile is lifted by the lift unit, it is possible to use as these sensors photo-coupler type sensors having a beam emitter for emitting a light beam and a beam receive for receiving the emitted light beam so as to detect presence of an object located on a path of the light beam. Further, just one pair of sensors provided adjacent the lateral sides of the automobile may suffice for this function.

Accordingly, the above construction of the present invention is more convenient than other constructions using e.g. an optical scanning sensor or more than two photo-coupler sensors vertically arranged to detect the entire lateral sides of the automobile.

According to a still further aspect of the present invention, in the automated high-raised parking system, the system further comprises a pair of illumination devices provided at the entrance/exit section for illuminating the lateral sides of the automobile and further comprises illumination control means for activating only one of the illumination devices corresponding to a steering wheel side of the automobile when this automobile is driven out of the parking system.

With the above feature, when the automobile is driven out of the parking system, only the illumination device corresponding to the steering wheel side of this automobile is illuminated, so that the driver may readily see which side to enter. Further, it is not necessary to illuminate the other illumination device located on the other side where the driver should not enter, thus saving the energy consumption for the illumination.

Further and other objects, features and effects of the invention will become more apparent from the following more detailed description of the embodiments of the invention with reference to the accompanying drawings.

DESCRIPTION OF THE PREFERRED EMBODIMENTS

Preferred embodiments of the present invention will be described in particular with reference to the accompanying drawings.

FIGS. 1 through 5 show an automated high-raised parking system according to one preferred embodiment in which a lift device of the invention is used in a lift-translator device C.

Figure 1:
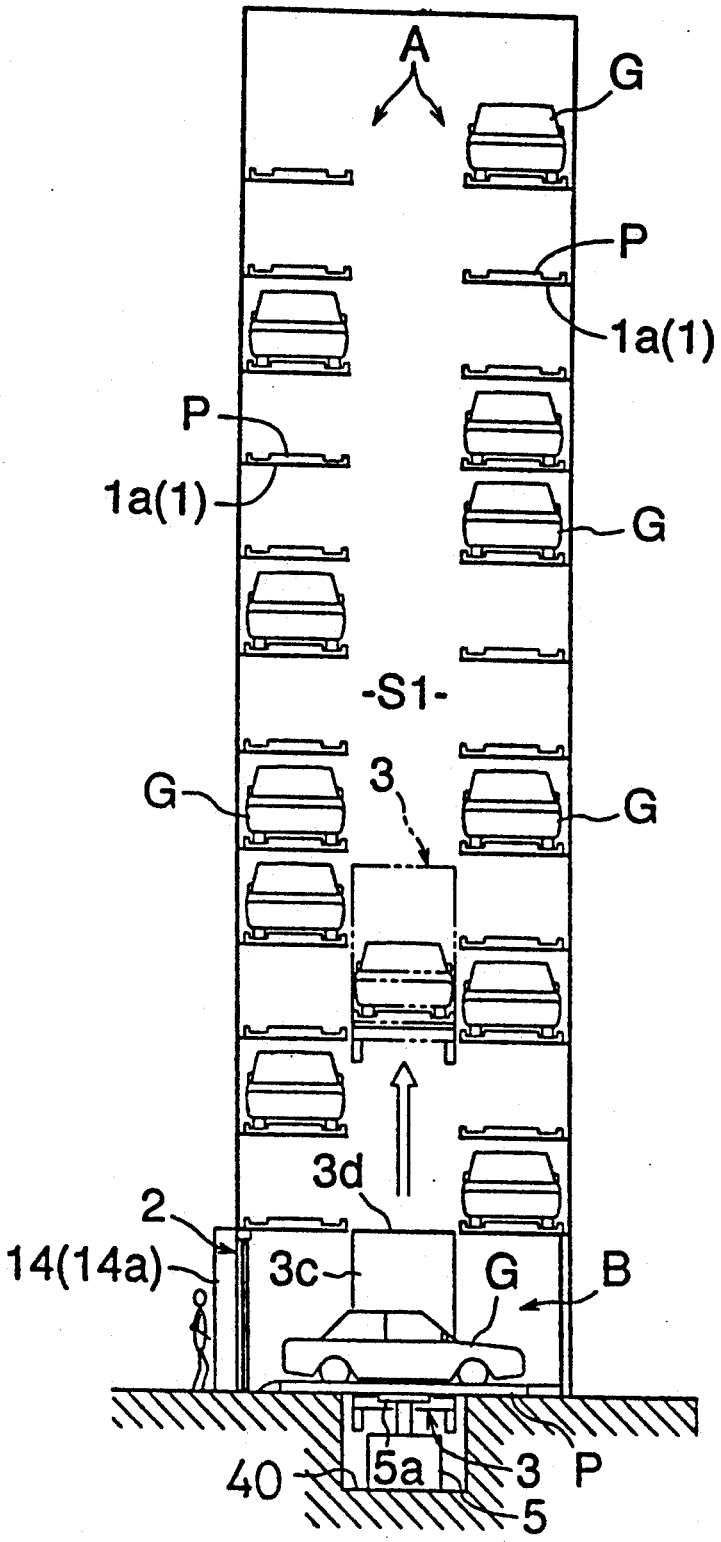
FIG. 1 is a side view showing an entire construction of an automated high-raised parking system according to one preferred embodiment of the present invention.

This automated high-raised parking system, as shown in FIG. 1, includes a parking rack structure A having a plurality of stories of racks 1 each for accommodating a pallet P for mounting and parking an automobile G thereon, an entrance/exit section B provided on a ground-level of the system and having an entrance-exit opening 2 for entrance and exit of the automobile, and a lift-translator device C having a lift unit 3 and used for lifting and translating the pallet P between the racks 1 and the entrance/exit section B.

In the present embodiment, a depth direction of the parking system is defined here to correspond to a direction extending from the entrance-exit opening to an innermost end of the entrance/exit section B. Whereas, a width direction of the parking system is defined here to correspond to a direction extending normal to the above-defined depth direction and along a lateral opening width of the entrance-exit opening 2.

The parking rack structure A includes a pair of rack units disposed side by side in the depth direction. Each rack unit includes the plurality of stories of racks 1. Each rack 1 includes the pallet P and a pair of receiver frames 1*a*, 1*a* for supporting opposed longitudinal ends of the pallet P, so that the automobile G is parked as being mounted on the pallet P.

Between the pair of rack units, there is formed a lift passage S1 extending along the facing sides of the rack units and communicated, at a lower end, with the entrance/exit section B.

As described hereinbefore, the entrance/exit section B includes the entrance-exit opening 2. For entrance or exit of the automobile G, the lift unit 3 is placed inside the section B. Under this section B, there is provided a pit 40 formed continuously with a lower end of the lift passage S1. Inside this pit 40, there is disposed a turntable device 5 having an elevatable and swivellable turntable 5*a*.

Inside the entrance/exit section B, the pallet P is so disposed as to have its longitudinal direction oriented toward the entrance-exit opening 2, and the automobile is driven onto and off this pallet P. For entrance, the pallet P mounting the automobile G is swiveled by 90 degrees by the turntable device 5 and then placed onto the lift unit 3 with an upward movement of this lift unit 3. For exit, with a lowering movement of the lift unit 3, the pallet P is translated onto the turntable 5*a* of the turntable device 5 and then swiveled thereon to be positioned in the entrance/exit section B.

Figure 2:
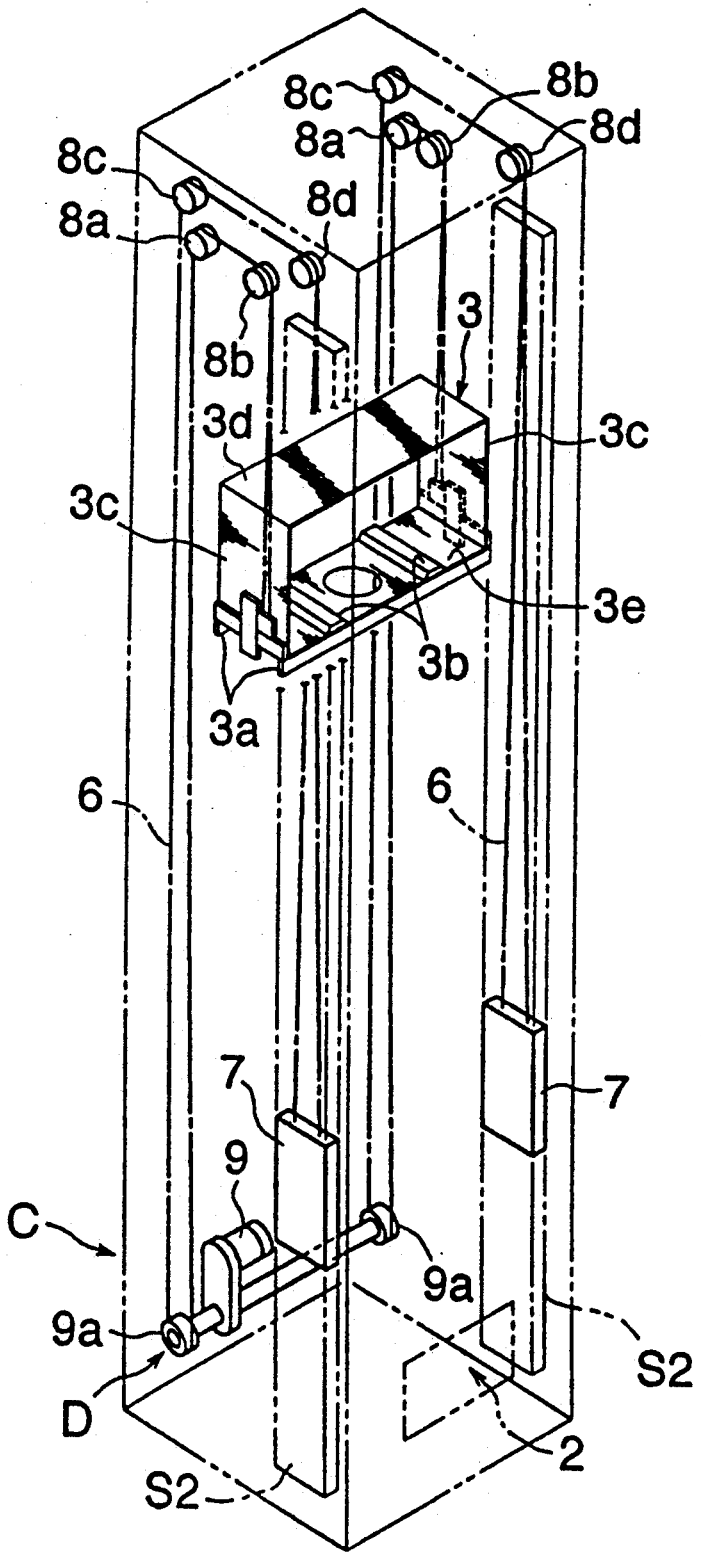
FIG. 2 is a perspective view showing a construction of a lift-translator device.

As shown in FIG. 2, the lift-translator device C includes the lift unit 3 vertically movable within the lift passage and a lift drive mechanism D for vertically moving the lift unit 3.

The lift unit 3 includes a frame 3*a*, a pair of expandable forks for supporting the pallet P and translating it to and from one rack 1, side plates 3*c* vertically extending from longitudinal opposed ends of the frame 3*a*, a shielding member 3*d* attached, like a roof, to upper portions of the side plates 3*c* and a floor plate 3*e*.

The lift drive mechanism D is connected via two cable members 6 with the lift unit 3 and two balance weights 7. Each cable member 6 is reeved around suspension pulleys 8*a*, 8*b*, 8*c*, 8*d* attached to upper ends of the parking rack structure A and a drive pulley 9*a* of the lift drive unit 9. Accordingly, the lift unit 3 having its longitudinal axis aligned along the afore-defined width direction is suspended inside the lift passage S1 by the cable members 6 reeved around the suspension pulleys 8*b* acting as guide members attached to the upper ends of the lift passage S1 and is vertically moved by operation of the lift drive unit 9.

The balance weight 7, inside a balance-weight lift passage S2 formed in parallel with the lift passage S1 and on a side of the width direction on the immediate side of the depth direction, is suspended and supported by the cable member 6 reeved around the suspension pulley 8*d* attached to the upper position of the balance-weight lift passage S2. Then, as the lift unit 3 is vertically moved in one direction, the balance weight 7 is vertically moved in the opposite direction by a distance corresponding to the vertical movement of the lift unit 3. Therefore, when the lift unit 3 is located at the entrance/exit section B, the balance weight 7 is located adjacent the upper end area of the balance-weight lift passage S2. Further, when the lift unit 3 is located beside the uppermost rack 1 of the parking rack structure A (this is defined as the uppermost position of the lift unit 3), the balance weight 7 is located adjacent the lower end of the balance-weight lift passage S2.

Figure 3:
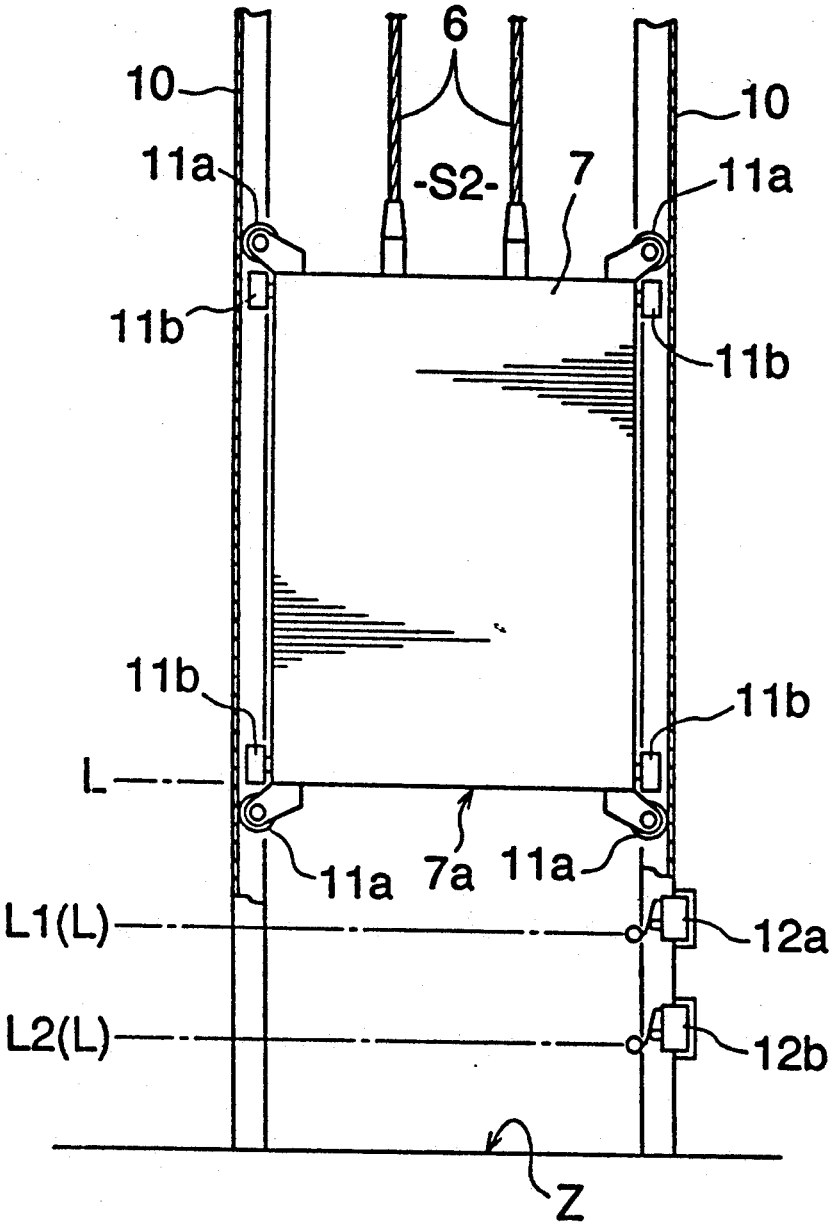
FIG. 3 is a side view showing a lower end of a lift passage for a balance weight.

FIG. 3 shows the latter condition where the balance weight 7 is located adjacent the lower end of the lift passage S2. Inside the balance-weight lift passage S2, two pairs of guide rails 10 are provided to bind opposed longitudinal ends of the balance weight 7 and to engage rollers 11*a*, 11*b* of this balance weight 7 thereby to guide the vertical movement of the balance weight 7.

Within the guide rails 11, there are attached limit switches 12*a*, 12*b* acting as detection means for detecting a height of the position of the balance weight 7; and the one limit switch 12*a* is attached at a position upwardly distant from a lower end Z of the lift passage by a height distance L1 while the other limit switch 12*b* is attached at a position lower than the position of the distance L1 and distant from the lower end Z by a distance L2.

Under a normal use condition of this parking system, the system is arranged so that a height position L of a lower end 7*a* of the balance weight 7 will not become lower than the height position L1. However, if there occurs elongation in the cable member 6, the balance weight 7 will be positioned lower gradually and will eventually contact the limit switch 12*a* and will further contact with the limit switch 12*b* to activate these switches.

Figure 4:
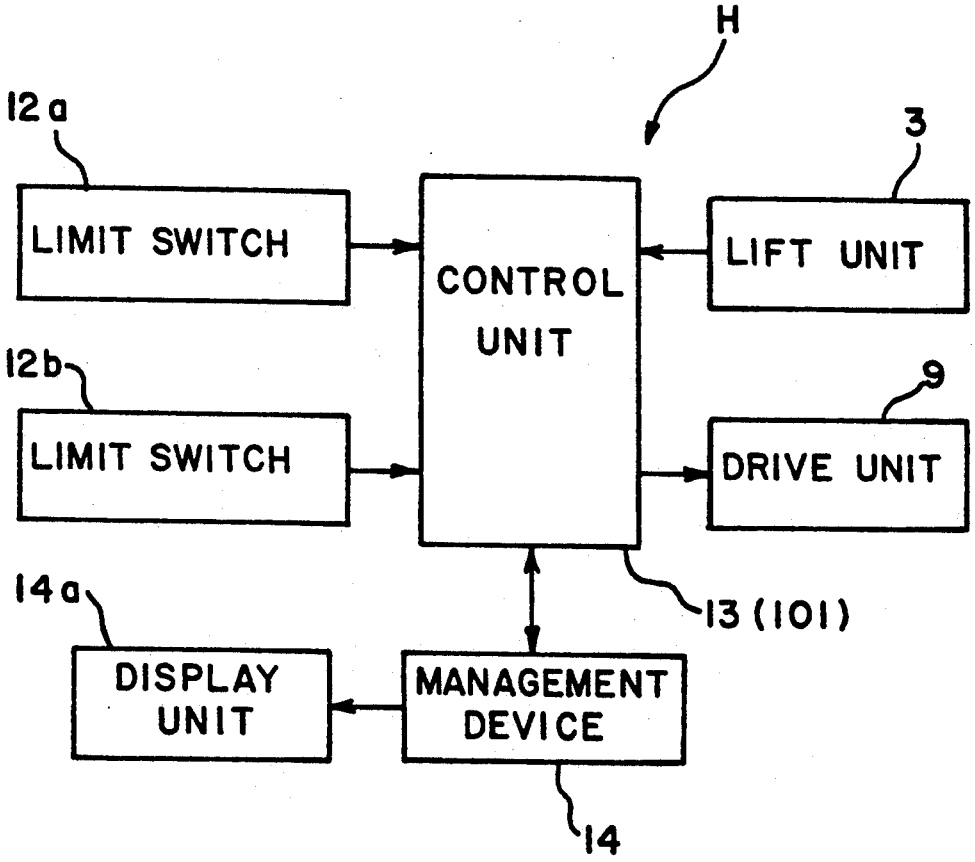
FIG. 4 is a block diagram of a lift control mechanism, FIGS. 5(*a*) and (*b*) show display screens of a display apparatus of a management device.

FIG. 4 shows a lift control mechanism H which controls the lift movement of the lift unit 3. This lift control mechanism H includes a microcomputer control unit 13 acting as the main element of the mechanism and operable to effect the lifting operations of the lift unit 3 through controlling drive operation of the lift drive unit 9 based on command information from a management device 14 and information concerning a present height position of the lift unit 3.

The control unit 13 is connected to the limit switches 12*a* and 12*b*.

Further, a warning means 101 is provided for warning abnormal elongation in the cable member 6 through a display unit 14*a* of the management device 14 when it is detected that the balance weight 7 is not positioned higher than the predetermined height value L1 relative to the lower end Z of the lift passage S2 when the lift unit 3 is located at the upper limit position.

Next, the warning operation of abnormal elongation in the cable member 6 in the automated high-raised parking system incorporating the lift device of the invention will be particularly described.

As described hereinbefore, in the normal use condition, the system is arranged so that the lower end 7*a* of the balance weight 7 will not become lower than the height position L1.

Then, if elongation gradually occurs in the cable member 6, the limit switch 12*a* is activated by the balance weight 7 and this activation of the limit switch 12*a* is confirmed by the control unit 13. Then, the warning means 101 issues a warning of abnormal elongation in the cable member 6 by displaying a message 15 illustrated in FIG. 5(*a*) in the display unit 14*a* of the management device 14. This display of the message 15 is continued until a proper measure is taken to correct the abnormal condition.

If no proper measure is taken on the cable member 6 and further elongation occurs in this cable member, the other limit switch 12*b* is activated by the balance weight 7. As this activation of the limit switch 12*b* is confirmed by the control unit 13, the warning means 101 provides a warning by displaying a further message 16 shown in FIG. 5(*b*) and the lift control mechanism H stops any lifting operations of the lift unit 3 thereafter.

In the foregoing embodiment, the detection means for detecting the present height position of the balance weight 7 comprises the limit switch 12*a* attached to the guide rails 10. Instead, the specific type and construction of sensor comprising this detection means may vary depending on the convenience. For instance, it is conceivable to employ a photo-interrupter type sensor or a magnet-sensitive type sensor. Further, the attaching position of the detection means may also vary as long as the means can detect the position of the balance weight 7 within the lift passage S2.

Also, the attaching height of the sensor may vary conveniently as long as the sensor is attached at such a height position that it may detect the height of the balance weight 7 when the lift unit 3 is located at a predetermined height position.

Figure 5A:
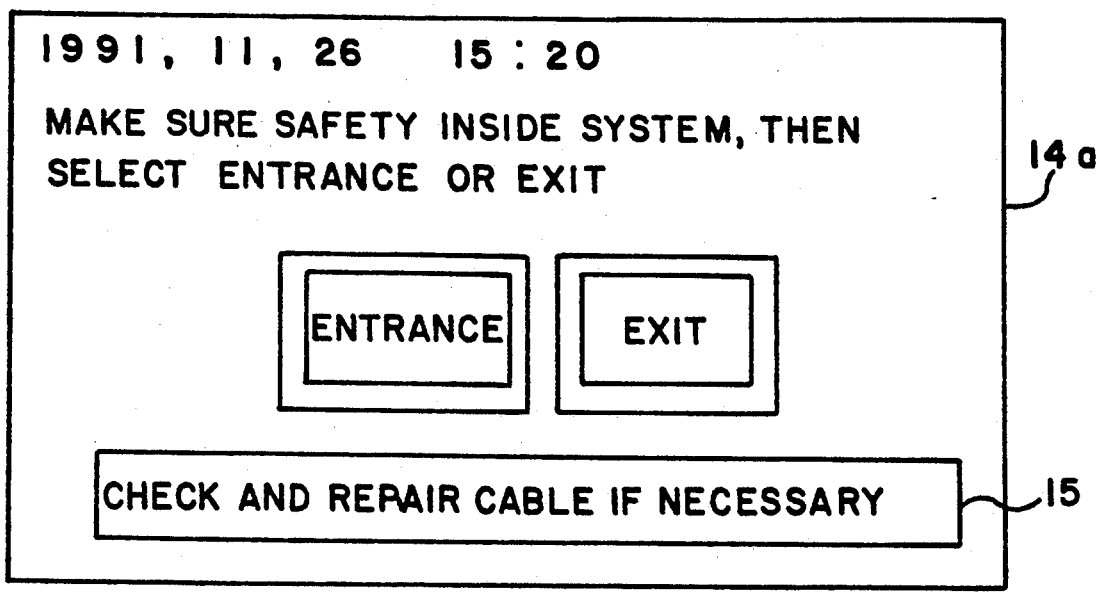
Figure 5B:
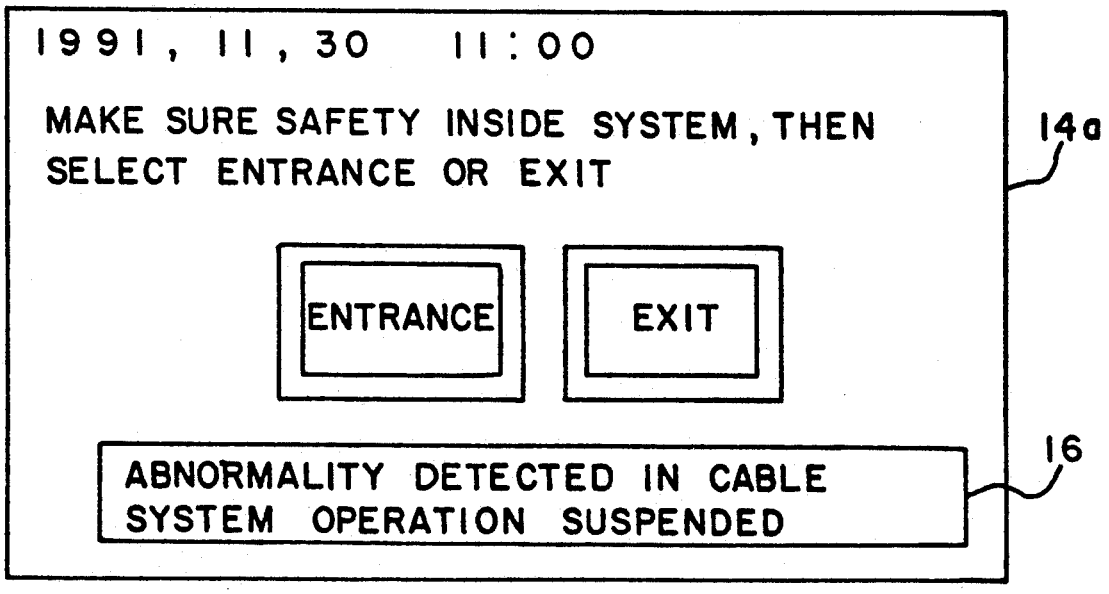

The display screen of the display unit 14*a* shown in FIG. 5 is just illustrative and is not limited thereto. Further, the message 15, 16 may vary depending on the convenience.

Next, a further embodiment of the present invention will be described.

Figure 6:
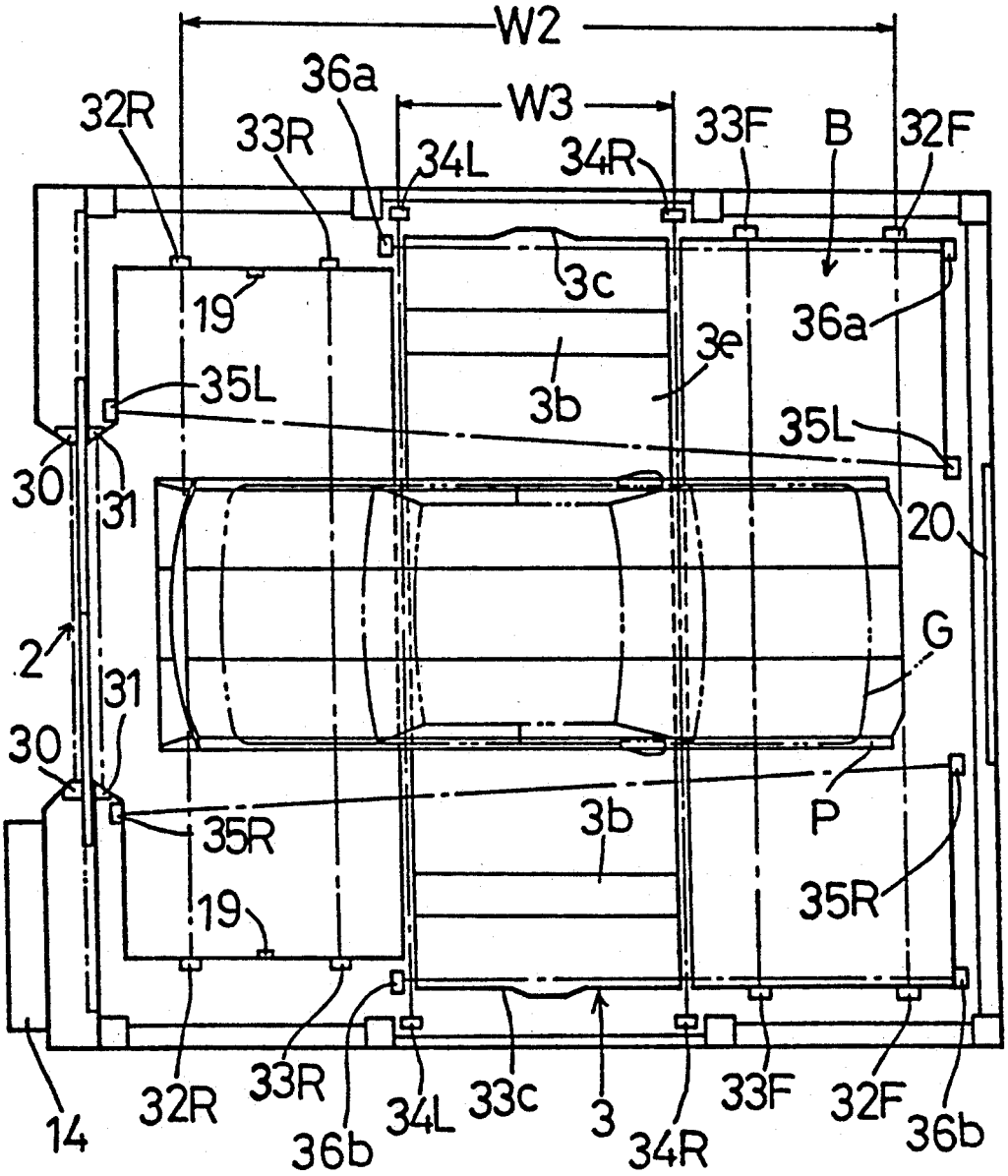
FIG. 6 is a plan view showing an inside of an entrance/exit section of an automated high-raise parking system according to a further embodiment of the present invention.

FIG. 6 shows an inside of an entrance/exit section B relating to this further embodiment. In this condition, the lift unit 3 is lowered to be present within the pit 40. The pallet P is placed at the substantially central area of the entrance/exit section B, with the longitudinal axis of the pallet being oriented to the inner side of the section. Then, the automobile G is driven past the entrance-exit opening 2 to enter the entrance/exit section B and is driven straight further onto the pallet P. Then, this pallet P mounting the automobile G is elevated by the turntable 5*a* of the turntable device 5 disposed centrally and downwardly of the pallet P and then is swiveled by 90 degrees. Further, as shown in FIG. 7, with an upward movement of the lift unit 3, the pallet is placed onto this lift unit 3.

Figure 7:
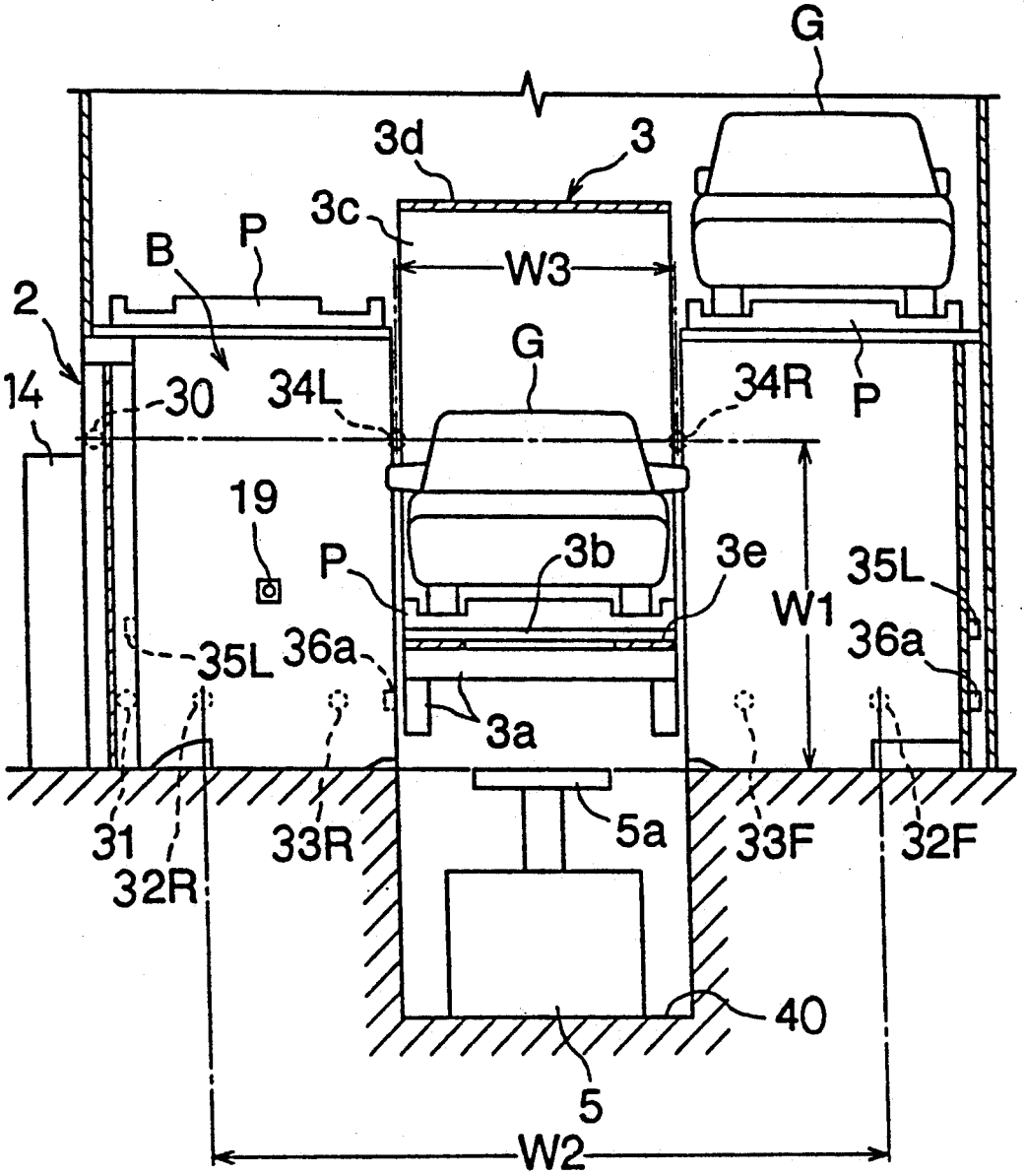
FIG. 7 is a side view showing the inside of the entrance/exit section of the embodiment of FIG. 6.

FIGS. 6 and 7 show various types of sensors. These sensors are so-called photo-coupler type sensors having a beam receiver and a beam emitter. Optical axes of the sensors are denoted by dotted lines.

Next, these sensors will be particularly described.

At the entrance-exit opening 2, there are provided a vertical-displacement sensor 30 and an automobile-passage sensor 31 with its optical axis being extend along the width direction of the opening 2.

An optical axis of the vertical-displacement sensor 30 is set at an upper height limit of a predetermined allowable zone W1 extending along the longitudinal and width directions of the automobile and predetermined based on the vertical width of the rack 1 of the parking rack structure A. Accordingly, as the automobile G extending beyond the predetermined allowable zone W1 drives past the entrance-exit opening 2, the portion of the automobile extending beyond the zone will interrupt the optical axis, so that entrance and exit of the automobile may be detected.

Inside the entrance/exit section B, there are provided longitudinal-displacement sensors 32F, 32R, automobile-position sensors 33F, 33R and side-displacement sensors 34L, 34R with the optical axes being extended along the width of the entrance-exit opening 2. Inside this entrance/exit section B, there are further provided door-opening sensors 35L, 35R and automobile-displacement sensors **36*a*, 36*b* with the optical axes thereof being extended along the width of the entrance-exit opening 2**.

The optical axes of the longitudinal-displacement sensors 32F, 32R are set to extend along opposed longitudinal edges of the pallet P placed at the entrance-exit position and at a height where an automobile of ordinary dimensions should be present. Further, a distance between these optical axes determines forward and rear limits of a predetermined longitudinal allowable zone W2 extending along the longitudinal direction of the automobile. Accordingly, as the body of the automobile G interrupts the optical axis of the longitudinal-displacement sensor 32F, it is detected that this automobile G has been displaced towards the rear side of the pallet P. On the other hand, when the optical axis of the other longitudinal-displacement sensor 32R is interrupted by the automobile body, it is detected that this automobile has been displaced towards the forward side of the pallet P. Further, if both of the optical axes of the two sensors 32F, 32R are interrupted, it is detected that this automobile has a longitudinal length exceeding the longitudinal allowable zone W2.

The optical axes of the automobile-position sensors 33F, 33R are set at an intermediate position of the optical axes of the longitudinal-displacement sensors 32F, 32R or lateral sides of the pallet at the center of the longitudinal direction of the pallet P and at a height where an automobile of ordinary dimensions is to be present. Accordingly, as these optical axes are interrupted by the body of the automobile G, it is detected that this automobile G is mounted on the pallet P. Further, if only the optical axis of the one automobile-position sensor 33F is interrupted, it is detected that the automobile G is displaced towards the inner side of the pallet P. Conversely, if only the optical axis of the other automobile-position sensor 33R is interrupted, it is detected that the automobile is mounted on the pallet P with displacement towards the immediate side of the pallet. When the optical axes of both of the automobile-position sensors 33F, 33R are interrupted, it is detected that the automobile G is mounted at the predetermined proper position on the pallet P.

Incidentally, the distance between the optical axes of the two automobile-position sensors 33F, 33R needs to be shorter than a longitudinal length of ordinary automobiles including compact cars having shorter lengths, yet, this distance should be as long as possible for the purpose of effectively detecting the displacement of the mounting position of the automobile on the pallet P.

The optical axes of the door-opening sensors 35L, 35R are sent along the lateral edges of the pallet P and at a height where a door of an ordinary automobile is to be present. Then, when the door of the automobile G mounted on the pallet P is opened, the optical axes of said sensors are interrupted to detect this door opening.

The optical axes of the automobile-displacement sensors **36*a*, 36*b* are set along the longitudinal edges of the lift unit 3 and at a height where an ordinary automobile is to be present. Accordingly, after the pallet P is swiveled by 90 degrees by the turntable device 5**, if the automobile mounted on the pallet is displaced in the longitudinal direction, the optical axes are interrupted to detect this longitudinal displacement.

The optical axes of the side-displacement sensors 34L, 34R are set along the lateral edges of the lift unit 3 and at the upper limit position of the predetermined allowable zone W1. And, a distance between these optical axes of the sensors 34L, 34R regulates the left-hand and right-hand limits of a predetermined allowable zone W3 extending along the width direction of the automobile and predetermined based on the accommodating space of the rack 1.

FIG. 7 shows the inside of the entrance/exit section B where the lift-up operation of the lift unit 3 has been just started. With the upward movement of the lift unit 3, the automobile first passes an intermediate position between the optical axes of the side-displacement sensors 34L, 34R. Therefore, even if any portion of the automobile body G exceeds the predetermined allowable zone W3 at any lifting height of the automobile, with the upward movement of the lift unit 3, the optical axes of said sensors are inevitably interrupted, so that it is detected that this automobile G is not positioned within the predetermined allowable zone W3.

Figure 8:
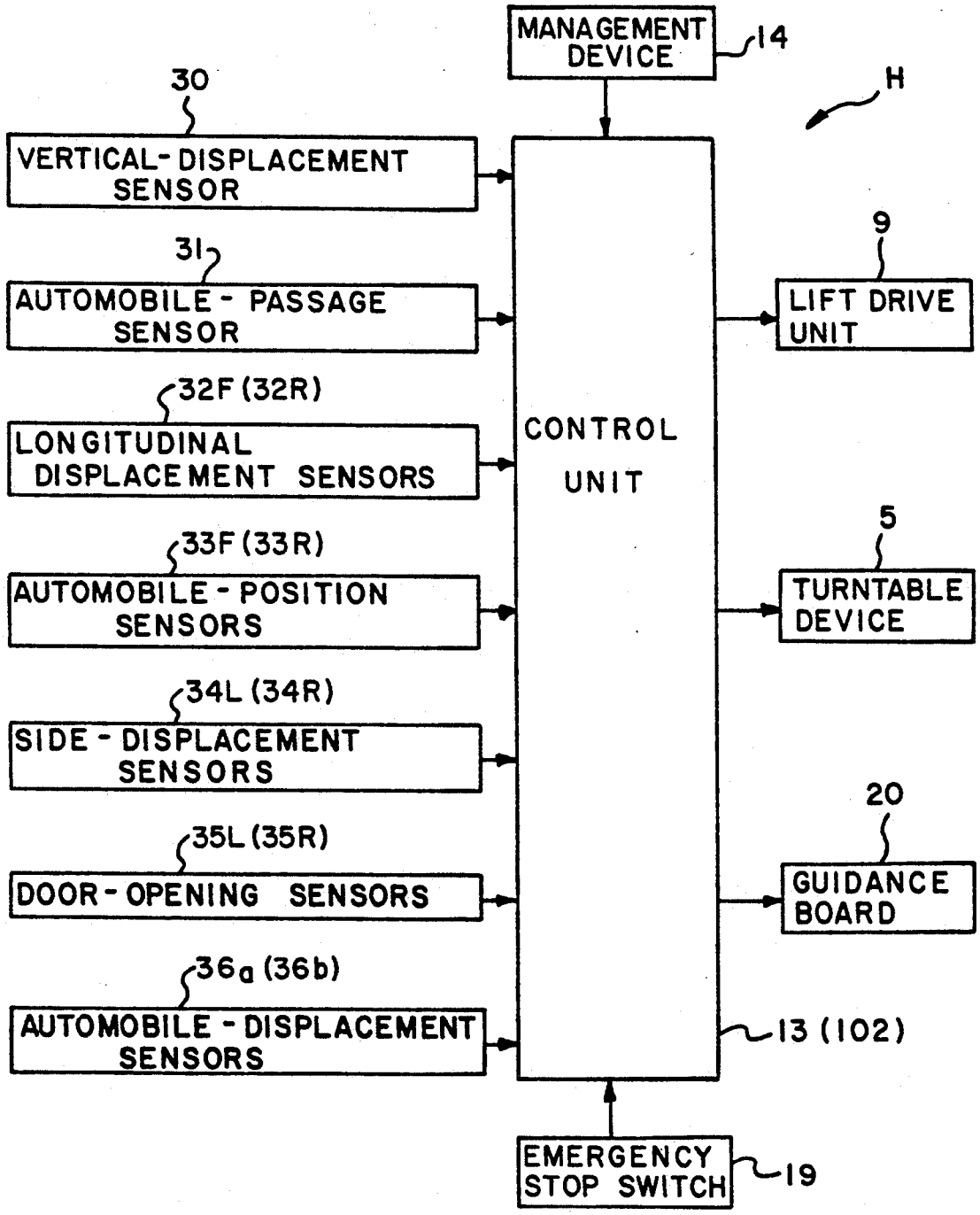
FIG. 8 is a block diagram of a control mechanism used in the embodiment of FIG. 6.

FIG. 8 shoes a control mechanism H' used in the automated high-raised parking system of this invention. This control mechanism H' includes the microcomputer control unit 13 as the main component thereof and is connected to the management device 14, the lift drive unit 9 and to the turntable device 5. Based on an entrance or exit command from the management device 14, the lifting operation of the lift unit 3, the swiveling operation of the turntable **5*a* of the turntable device 5** are controlled.

Further, the control unit 13 is connected to all the above-described sensors 30, 31, 32F, 32R, 33F, 33R, 34L, 34R, 35L, 35R, **36*a*, 36*b* as well as to an emergency stop switch 19 and a guidance board 20. And, an abnormality-management means 102 is provided for controlling the lifting operation of the lift unit 3, the swiveling operation of the turntable device 5 and a display operation of the guidance board 20, based on signals transmitted from the above sensors and the emergency stop switch 19**.

Incidentally, the management device 14 is disposed on a side of an outer wall of the parking system beside the entrance-exit opening 2. The emergency stop switch 19 is attached to a side inner wall adjacent the entrance-exit opening 2 inside the entrance/exit section B, so that the operations of the parking system may be stopped in the case of an emergency by the control of the control mechanism H. The guidance board 2 is attached to the innermost side face of the entrance/exit section B for e.g. electrically displaying various kinds of messages.

An entrance operation of the automobile G using the automated high-raised parking system of this invention will be particularly described next.

FIG. 6 shows the inside of the entrance/exit section B ready for entrance of the automobile G. The automobile G enters the entrance/exit section B through the entrance-exit opening 2. This entrance of the automobile G is detected by the automobile-passage sensor 31 and the guidance board 20 displays a message to the effect that the automobile should be driven further straight and be stopped at the predetermined position on the pallet P. However, in the course of this, if the vertical-displacement sensor 30 detects any vertical displacement, the guidance board 20 displays a message notifying this abnormality. Then, until the automobile G is evacuated from the entrance/exit section B through the entrance-exit opening 2, any further entrance operations will be temporarily stopped.

The automobile G introduced into the entrance/exit section B is further driven straight onto the pallet P. First, as the longitudinal-displacement sensor 32R detects the position of the automobile G, the guidance board 20 displays a message to the effect that the automobile should be advanced by some more distance. With cessation of the detection by the longitudinal-displacement sensor 32R, if the automobile-position sensor 33R alone detects the presence of the automobile, the guidance board displays the message for requesting further advancement of the automobile. On the other hand, if the other automobile-position sensor 33F alone detects the presence of the automobile, the guidance board displays a message requesting a slight backward movement of the automobile. Then, if neither of these automobile-position sensors 33F, 32R detect the presence of automobile, the guidance board displays a message requesting stop of the automobile at the present position and exit of the driver from this automobile. Further, in case the one longitudinal-displacement sensor 32F detects the automobile before the detection by the other longitudinal-displacement sensor is ended, the guidance board displays a message notifying of abnormality and any further entrance operations are suspended until the automobile G is evacuated from the entrance/exit section B through the entrance-exit opening 2.

After getting out of the automobile G on the pallet P, the driver walks to the management device 14. Then, after confirming the safety inside the entrance/exit section B, the driver commands the control mechanism H' to initiate further entrance operations. In the course of this, if the door-opening sensors 35L, 35R detect opening of the automobile door, a warning message of this abnormality is displayed on the management device 14 and the guidance board 20; and further entrance operations are suspended until the entrance command is again given to the management device 14.

If such door opening is not detected, the pallet P is swiveled by 90 degrees by the turntable device 5 and moved to the position above the lift unit 3 with the longitudinal direction of the pallet P being oriented to the width direction. In the course of this, there sometimes occurs a slight longitudinal displacement of the automobile G on the pallet P e.g. because the driver failed to operate the parking brake of the automobile. In such case, the automobile-displacement sensors **36*a*, 36*b*** detect this displacement of the automobile and further entrance operations are suspended for the emergency.

If no such displacement is detected, with an upward movement of the lift unit 3, the pallet P is placed onto this lift unit 3 and then the lift unit with the pallet is elevated up to a predetermined rack 1.

In the course of the above, if the side-displacement sensors 34L, 34R detect side displacement, a message warning the abnormality is displayed on the management device 14 and the guidance board 20. In this case, the lift unit 3 is lowered and turntable device 5 is activated to return the pallet P to the entrance position described before. Then, until an entrance start command is again given to the management device 14, further operations are stopped. Incidentally, it often happens that the driver forgets to fold the foldable door mirrors; and such unfolded condition of the door mirrors is detected as side displacement. In this case, as the driver folds the door mirrors of the automobile returned to the original position and then commands the start of entrance operations thereby to resume the operations until completion.

If no such side displacement is detected, the lift unit 3 is moved up to the rack 1 and pallet P is translated by the expandable forks **3*b* onto the rack 1**. This completes the entrance operation.

In the foregoing embodiments, all the sensors comprise photo-coupler type sensors. However, the specific type and construction of these sensors are not limited thereto but may vary depending on the convenience as long as they can achieve the intended objects.

Further, the attaching positions of the beam emitters and the beam receivers of these photo-coupler sensors may vary also depending on the convenience. And, their optical axes may be set along the vertical direction extending from the ceiling to the floor face or slanted relative thereto.

The specific contents of management operations effected by the abnormality-management means 102 may also vary conveniently.

A still further embodiment of the present invention will be described next.

Figure 9:
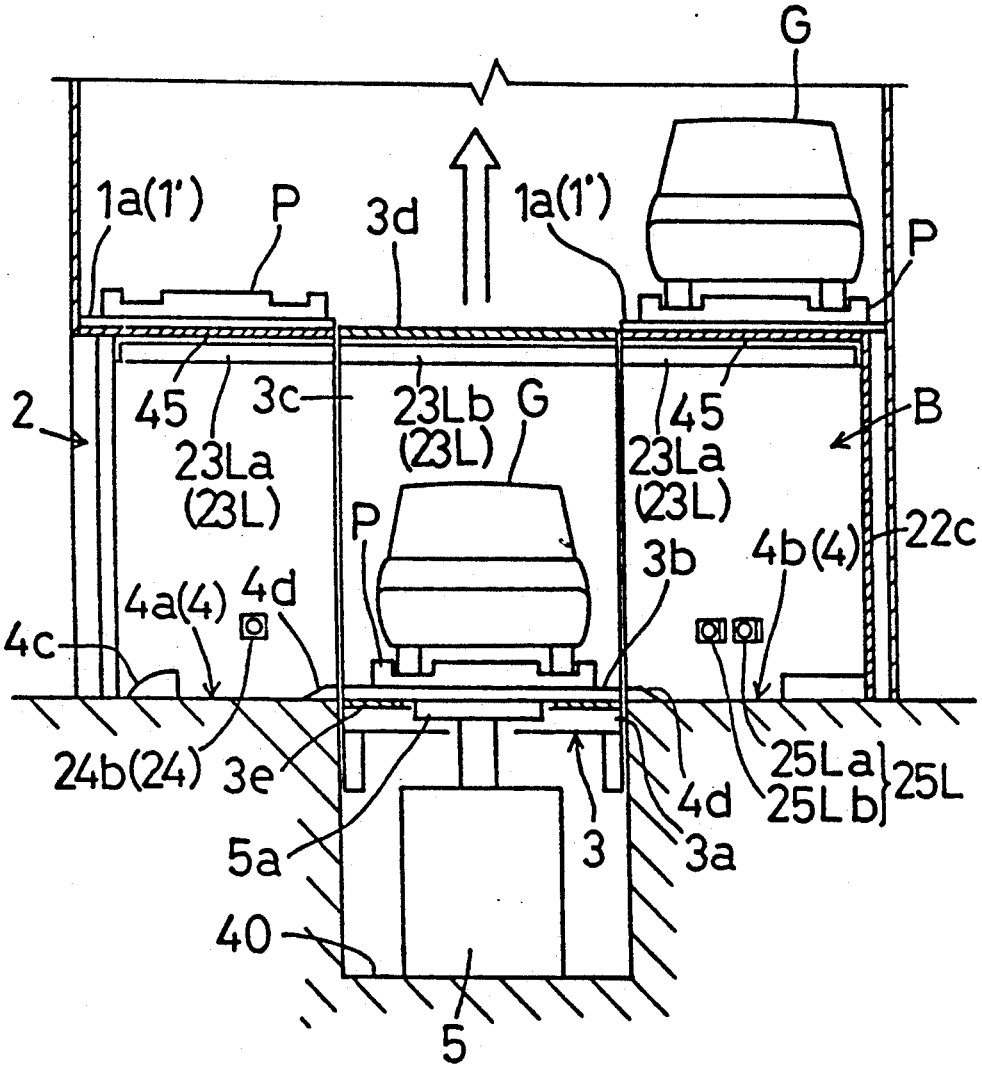
FIG. 9 is a side view showing an entrance/exit section of an automated high-raised parking system according to a still further embodiment of the present invention.

As shown in FIG. 9, the shielding member **3*d* is attached to the lift unit 3 in the manner described next. That is, when the lift unit 3 is stopped at the entrance/exit section B so that the floor plate 3*e* of the lift unit 3 and the floor face 4 of the section B are located at the same height to together form a flush surface, the shielding member 3*d* extends continuous with an auxiliary shielding member 45 attached to a lower face of a rack 1'** disposed immediately above the entrance/exit section B thereby to form a ceiling.

In the lift drive mechanism D, the lift unit 3 and the balance weight 7 are connected to the two cables 6; and each cable 6 is reeved about the suspension pulleys **8*a*, 8*b*, 8*c*, 8*d* and the drive pulley 9*a* of the lift drive unit 9. Accordingly, the lift unit 3 is suspended inside the lift passage S1 with the longitudinal direction of the lift unit being oriented along the width direction and is vertically moved by activation of the lift drive unit 9. The operations of this lift drive unit 9** are controlled by a control mechanism H'' to be described later.

As shown in FIGS. 1 and 9, at the entrance/exit section B, the lift unit 3 is located at this section for entrance or exit of the automobile G. The section B includes the entrance-exit opening 2 and the pit 40 is dug into the ground to extend continuous with the lower end of the lift passage S1. Further, within the pit 40, there is disposed the turntable device 5 having the elevatable and swivellable turntable **5*a***.

The entrance-exit opening 2 includes an entrance-exit door **2*a* automatically opened and closed by an unillustrated opening/closure drive device. The automatic opening and closure of this entrance-exit door 2*a* is also controlled by the control mechanism H''. In the condition shown in FIG. 1, the turntable device 5 elevates the turntable 5*a* to move the pallet P up away from the floor face 4 and then swiveled the pallet P by 90 degrees. Then, as illustrated in FIG. 9, the turntable 5*a* is lowered to place the pallet P onto the upper faces of the expandable forks 3*b* of the lift unit 3**. The turntable device is capable of operations in the opposite sequence.

These swiveling operations of the turntable device 5 too are controlled by the control mechanism H".

Figure 10:
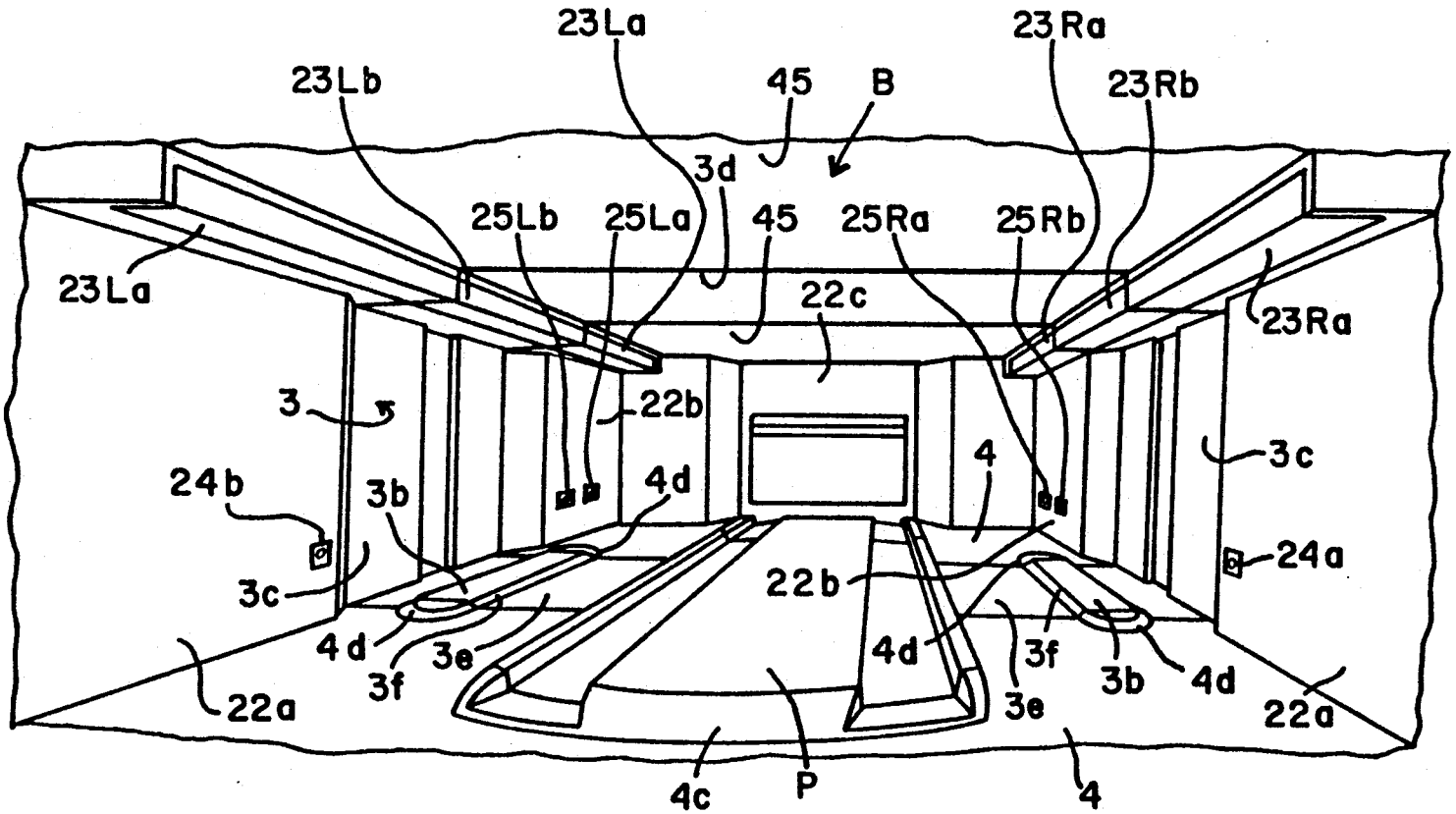
FIG. 10 is a view showing an inside of the entrance/exit section of the automated high-raised parking system of FIG. 9.
Figure 11:
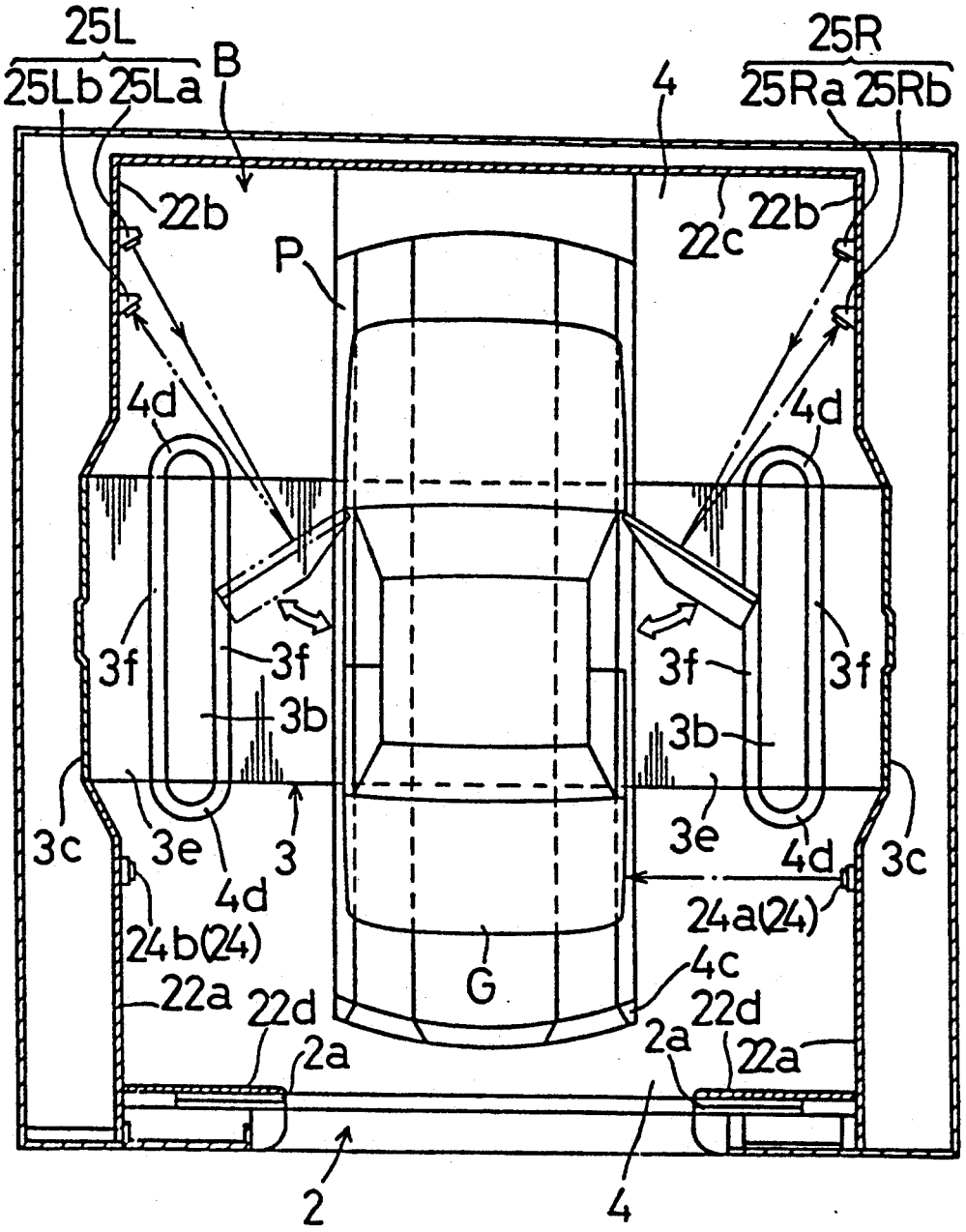
FIG. 11 is a plan view showing the entrance/exit section of the automated high-raised parking system of FIG. 9.

FIGS. 10 and 11 illustrate the inside of the entrance/exit section B where the lift unit 3 is located within the entrance/exit section B. As described hereinbefore, the auxiliary shielding member 45 and the shielding member 3*d* become continuous with each other to form the ceiling, while the floor face 4 and the floor plate 3*e* of the lift unit 3 become continuous with each other to form the flush floor surface. Also, inner plates 22*a*, 22*b*, 22*c*, 22*d* are attached to the inner side faces of the entrance/exit section B and on the lateral sides of the section the inner plates 22*a*, 22*b* and the side plate 3*c* of the lift unit 3 extend continuous with each other to form one continuous wall assembly.

The pallet P has its longitudinal direction aligned along the inner direction and has its longitudinal ends supported on the pallet mounting portions 4*a*, 4*b* formed by portions of the floor face 4. Also, the pallet is positioned at the predetermined proper automobile position provided centrally of the entrance/exit section B. Further, since a gap, i.e. height difference is formed between the upper face of the pallet P and the floor face 4, a guide member 4*c* having an inclined face for guiding automobile tires is disposed on the floor face 4.

Moreover, since a gap is also formed between the upper faces of the expandable forks 3*b* of the lift unit 3 and the floor face 4, tripping-prevention members 3*f*, 4*d* having inclined faces for preventing tripping of the driver are provided respectively on the floor plate 3*e* of the lift unit 3 and on the floor face 4.

At the lateral sides of the entrance/exit section B, there are provided pairs of illumination device 23L, 23R disposed side by side towards the inner direction. The illumination devices 23L, 23R include portions 23La, 23Ra attached to the auxiliary shielding member 5 and further portions 23Lb, 23Rb attached to the shielding member 3*d* to the lift unit 3.

Illumination operations of these illumination devices 23L, 23R are controlled by an illumination control means 103 for causing only one side of these illumination devices which side corresponds to the steering wheel side of the automobile G when this automobile G is withdrawn from the parking system.

To the inner plates 22*a*, there are attached a laser beam emitter 24*a* and a laser beam receiver 24*b* with the emitter and the receiver facing each other. These emitter and receiver together constitute an automobile-presence detecting sensor 24. This automobile-presence detecting sensor 24 is constructed so that an automobile-presence signal F1 is transmitted to the illumination control means 103 when the automobile G mounted on the pallet P interrupts the laser beam.

To the further inner plates 22*b*, there are attached laser beam emitters 25La, 25Ra and laser beam receivers 25Lb, 25Rb. These emitters and receivers constitute reflection detecting sensors 25L, 25R. With these reflection detecting sensors 25L, 25R, when a door of the automobile G is opened, this opened door acts as a reflecting board and the laser beam reaches either of the receivers 25Lb or 25Rb and then a reflection signal F2 or F3 is transmitted to the illumination control means 103.

Figure 12:
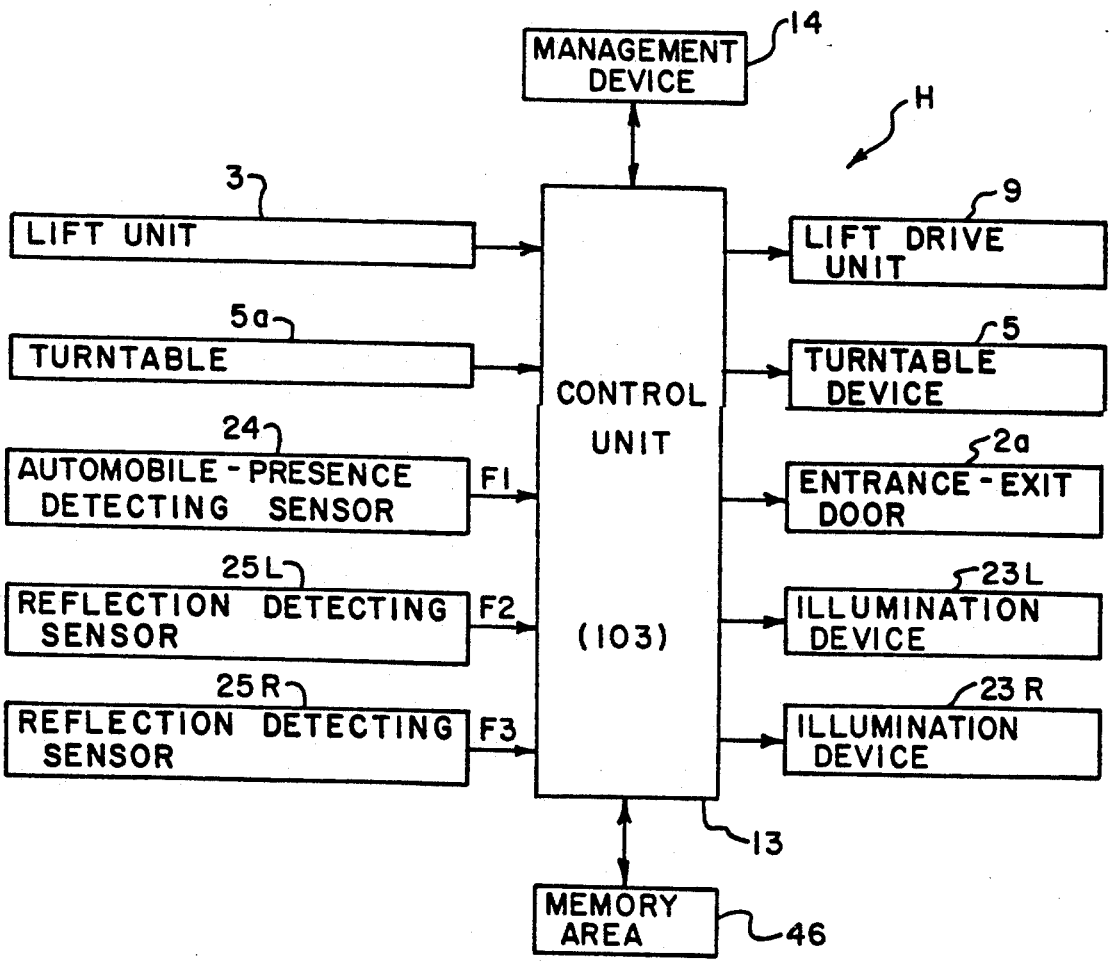
FIG. 12 is a block diagram of a control mechanism used in the automated high-raised parking system of FIG. 9.

As illustrated in FIG. 12, the illumination control means 103 includes a memory area for storing information concerning whether the automobile G parked on the parking rack structure A has the right-side steering wheel or left-side steering wheel for the automobile G parked on each rack 1. Based on this stored information and on the automobile-presence signal F1, the illumination devices 23L, 23R are turned on or off. The information concerning the right-side steering wheel or the left-side steering wheel may be obtained as the reflection signals F2, F3 from the reflection detecting sensors 25L, 25R generated in association with opening of the door of the automobile G to allow exit of the driver from the automobile.

Incidentally, the illumination control means 103 is constructed as a component of the control mechanism H".

The control mechanism H", as shown in FIG. 12, includes the microcomputer control unit 13 as the major component thereof, the memory area 46 and the management device 14 to be operated by a parking attendant. Then, to this mechanism, the information concerning the swiveling operations of the turntable 5*a*, the automobile-presence signal F1 from the automobile-presence sensor 24 and the reflection signals F2, F3 from the reflection detecting sensors 25L, 25R are inputted; and based on these pieces of information the operations of the lift drive unit 9 and the turntable device 5 and the opening/closing operation of the entrance-exit door 2*a* and the illumination operations of the illumination devices 23L, 23R are controlled.

The management device 14, which is operated by an attendant, is adapted to receive from the attendant a command for closing the entrance-exit door 2*a* and a command for withdrawing a predetermined automobile G parked on the parking rack structure A for exit of this automobile.

Next, an entrance operation of the automobile G using the automated high-raised parking system of this embodiment will be particularly described.

FIG. 10 shows the inside condition of the entrance/exit section B when ready for entrance of an automobile. In this condition, the entrance-exit door 2*a* is opened and the illumination devices 23L, 23R are turned off.

After allowing any other passenger except for the driver to get out of the automobile G, the automobile G is driven past the entrance-exit door 2*a* into the entrance/exit section B and driven further onto the pallet P. Then, the automobile-presence detecting sensor 24 detects presence of the automobile and emits the automobile-presence signal F1. Based on this signal F1, the control mechanism H" causes the illumination devices 23L and 23R to illuminate the inside of the entrance/exit section B.

Then, the driver gets out of the automobile through the door adjacent the steering wheel. In the course of this, either of the reflection detecting sensors 25L or 25R emits the reflection signal F2 or F3. Then, with detection of the reflection signal F2, the control mechanism H" turns off the illumination device 23R. Conversely, with detection of the reflection signal F3, the mechanism turns off the other illumination device 23L. Further, this reflection signal F2 or F3 is stored in the control mechanism H" as the information concerning the right-side or left-side steering wheel of this automobile G in connection with a predetermined rack 1 on which the pallet P presently placed in the entrance/exit section B is to be accommodated.

Then, the driver walks out of the entrance/exit section B through the entrance-exit door 2*a*. After confirming the exit of the driver, the system attendant inputs a command to the management device 14 to close the entrance-exit door 2a. Based on this door-closing command, the control mechanism H" turns off the still illuminated illumination device 23L or 23R and closes the entrance-exit door 2a.

Thereafter, the turntable device 5 elevates the turntable 5a to move the pallet P up away from the floor face 4, swivels the turntable 5a by 90 degrees and then lowers this turntable to place the pallet P onto the upper faces of the expandable forks 3b of the lift unit 3. Then, the lift unit 3 is moved upwards to be stopped beside the predetermined rack 1 for this pallet P. After this, the expandable forks 3b are expanded to translate the pallet P onto the rack 1 and as the lift unit 3 is lowered, the pallet P is placed on the receiver frame 1a of the rack 1. Then, the expandable forks 3b are retracted to complete the entrance operation.

Next, an exit operation of the automobile G will be particularly described.

The system attendant inputs to the management device 14 a command requesting exit of a predetermined automobile G parked on the parking rack structure A. Then, the lift unit 3 is moved up to the side of the rack 1 accommodating this automobile G and through the reverse operation steps to those for the above-described entrance operation, the pallet P is translated onto the lift unit 3 and this unit is lowered within the lift passage S1 to be stopped at the entrance/exit section B. Then, the turntable device 5 elevates the turntable 5a to move the pallet P up off the upper faces of the expandable forks 3b of the lift unit 3. Next, the pallet is swiveled by 90 degrees so that the longitudinal direction of the pallet P is positioned along the reverse direction to that for the entrance of the automobile G. That is, after changing the orientation of the longitudinal direction of the automobile to the reverse direction, the turntable 5a is lowered to place the pallet P onto the pallet-mounting portions 4a, 4b of the floor face 4.

After completion of the above operations, based on the information stored at the memory area 46 relating to this designated automobile, the control mechanism H" illuminates only the illumination device 23L in case this automobile has the left-side steering wheel or only the other illumination device 23R in case the automobile has the right-side steering wheel. In this condition, the entrance-exit door 2a is automatically opened. Incidentally, the information stored in the memory area 46 concerning this automobile is canceled.

Then, the driver enters the entrance-exit section B through the entrance-exit door 2a and walks to the side of the automobile G illuminated by the illumination device and gets into the automobile. Then, the automobile G is driven out of the entrance/exit section B through the entrance-exit door 2a. With end of the automobile-presence signal F1, the control mechanism H" turns off the still illuminated illumination device 23R to complete the exit operation of the automobile G.

Incidentally, after the completion of the exit operation, the entrance/exit section B is under the same condition as that ready for entrance operation. Therefore, an exit operation and an entrance operation can be effected in a continuous manner.

In case only entrance operation is effected one after another, in the condition of the exit operation, a pallet P of a rack 1 un-occupied with any automobile G will be conveyed to the entrance/exit section B. In this case, illumination operations of the illumination devices 23L, 23R will not be necessary.

On the other hand, in case only exit operation is effected one after another, in the condition of the entrance operation, only the pallet P will be accommodated on the predetermined rack 1. In this case too, the illumination operations of the illumination devices 23L, 23R will not be needed.

In the foregoing embodiment, the illumination control means 103 is constructed as an automatic means having the automobile-presence sensor 24 and the reflection detecting sensors 25L, 25R. Instead, this can be constructed as a manual means to be switch-operated by the parking attendant.

Further, by eliminating the reflection detecting sensors 25L, 25R, it is conceivable to arrange the system so that the parking attendant detects the information concerning the right-side or left-side steering wheel.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which become within the meaning and range of equivalency of the claims are therefore intended to be embraced therein.

What is claimed is:

1. A lift device comprising:

a cable member having opposed ends thereof suspended via guide members and longitudinally movable by a lift drive unit;

a lift unit connected to one of the ends of said cable member for lifting an object along a lift passage;

a balance weight connected to the other end of said cable member and movable along a balance-weight lift passage;

detection means for detecting a height of said balance weight to check whether or not the balance weight is positioned higher than a lower end of said balance-weight lift passage by a predetermined value when said lift unit is moved to its uppermost position; and warning means for warning an abnormal elongation of said cable member if said detection means detects that said balance weight is not positioned higher than said lower end of the balance-weight lift passage by said predetermined amount.

2. A lift device as defined in claim 1, further comprising:

a control mechanism for controlling a lifting operation of said lift unit, said control mechanism including a microcomputer control unit as a major component thereof and operable to effect said control operation of the lift operation of the lift unit through control of a drive of said lift drive unit based on a command from a management device and information relating to a preset height position of said lift unit.

3. A lift device as defined in claim 2, wherein said detection means comprises a limit switch activated with abnormal elongation of said cable member, said activation of the limit switch being detected by said control unit and said warning means causing a display unit of said management device to display a message thereon to warn the abnormal elongation of said cable member.

4. A lift device as defined in claim 3, wherein a further limit switch is attached at a position lower than an attaching position of said limit switch, said further limit switch being activated with further abnormal elongation of the cable member so that said control unit detects this activation of said further limit switch and causes said warning means to display a message thereon and also stops a lift operation of said lift unit.

5. An automated high-raised parking system comprising:

a parking rack structure including a plurality of stories of racks each for parking an automobile;

an entrance/exit section for allowing entrance and exit of the automobile;

a lift-translator device having a lift device movable between said entrance/exit section and said racks to convey the automobile;

said lift device including;

a cable member having opposed ends thereof suspended via guide members and longitudinally movable by a lift drive unit;

a lift unit being connected to one of the ends of said cable member for lifting the automobile along a lift passage, a balance weight connected to the other end of said cable member and movable along a balance-weight lift passage;

detection means for detecting a height of said balance weight to check whether or not the balance weight is positioned higher than a lower end of said balance-weight lift passage by a predetermined value when said lift unit is moved to its uppermost position; and warning means for warning an abnormal elongation of said cable member if said detection means detects that said balance weight is not positioned higher than said lower end of the balance-weight lift passage by said predetermined amount.

6. An automated high-raised parking system as defined in claim 5, wherein said entrance/exit section includes an entrance-exit opening, said lift unit being positioned inside said entrance/exit section for entrance or exit of the automobile, a pit being provided under said section to be continuous with a lower end of said lift passage, said pit accommodating therein a turntable device having an elevatable and swivelable turntable.

7. An automated high-raised parking system as defined in claim 6, further comprising:

a control mechanism for controlling a lifting operation of said lift unit, said control mechanism including a microcomputer control unit as a major component thereof and operable to effect said control operation of the lift operation of the lift unit through control of drive of said lift drive unit based on a command from a management device and information relating to a preset height position of said lift unit.

8. An automated high-raised parking system as defined in claim 7, wherein said detection means comprises a limit switch activated with abnormal elongation of said cable member, said activation of the limit switch being detected by said control unit and said warning means causing a display unit of said management device to display a message thereon to warn the abnormal elongation of said cable member.

9. An automated high-raised parking system as defined in claim 8, wherein a further limit switch is attached at a position lower than an attaching position of said limit switch, said further limit switch being activated with further abnormal elongation of the cable member so that said control unit detects this activation of said further limit switch and causes said warning means to display a message thereon and also stops a lift operation of said lift unit.

10. An automated high-raised parking system as defined in claim 6, further comprising:

further detection means for detecting whether an automobile introduced into said entrance/exit section of the system is positioned within a predetermined zone provided at said entrance/exit section along a direction of the width of the automobile.

11. An automated high-raised parking system as defined in claim 10, further comprising:

abnormality-management means activated when said further detection means detects absence of the automobile within said predetermined zone.

12. An automated high-raised parking system as defined in claim 11, wherein said further detection means comprises a pair of sensors to detect whether opposed lateral sides of the automobile to be lifted by said lift unit are located within said predetermined zone or not.

13. An automated high-raised parking system as defined in claim 12, wherein said sensors are photo-coupler sensors each having a beam emitter and a beam receiver.

14. An automated high-raised parking system as defined in claim 10, wherein inside said entrance/exit section, there are further provided longitudinal-displacement sensors, automobile-position sensors and side-displacement sensors, door-opening detecting sensors and automobile-displacement sensors, all these sensors being controlled by said control mechanism.

15. An automated high-raised parking system as defined in claim 14, wherein all said sensors comprise photo-coupler sensors each having a beam emitter and a beam receiver.

16. An automated high-raised parking system as defined in claim 6, wherein inside said entrance/exit section, there are further provided illumination devices arranged on opposed sides of said section where the automobile is to be present, illumination control means being provided for illuminating only one of said illumination devices disposed on a side corresponding to a steering-wheel side of the automobile when the automobile is withdrawn from the system.

17. An automated high-raised parking system as defined in claim 16, wherein said illumination control means is constructed as a component of said control mechanism, and wherein said control mechanism includes;

a microcomputer control unit as a major component of said mechanism, a memory area for storing information concerning whether the automobile parked on said parking rack structure has a right-side steering wheel or left-side steering wheel in connection with one of said racks, a management device for providing an entrance command or an exit command, said control mechanism being operable to receive information relating to a lift operation of said lift unit, information relating to a swiveling operation of said turntable, an automobile-presence signal from said automobile-presence sensor, reflection signals from reflection detecting sensors for detecting reflection signals from a door of the automobile acting as a reflection board when the door is opened, and based on said information and said signals, said control mechanism controlling the lift operation of said lift drive unit, the swivel operation of said turntable device and an opening/closing operation of an entrance-exit door provided at said entrance/exit section and the illumination operation of said illumination devices.

* * * * *

UNITED STATES PATENT AND TRADEMARK OFFICE

CERTIFICATE OF CORRECTION

PATENT NO. : 5,281,069

DATED : January 25, 1994

INVENTOR(S) : Kazushi Tsujimoto

It is certified that error appears in the above-indentified patent and that said Letters Patent is hereby corrected as shown below:

Column 6 Line 33 "message" should read --messages--.

Column 7 Line 37 "or" should read --on--.

Column 11 Line 33 "device" should read --devices--.

Column 11 Line 38 "3d to" should read --3d of--.

Claim 2 Line 54 Column 14 "a drive" should read --drive--.

Signed and Sealed this

Thirty-first Day of May, 1994

Bruce Lehman

*Attest:*

BRUCE LEHMAN

*Attesting Officer*

*Commissioner of Patents and Trademarks*